US005195865A

United States Patent [19]

Koehl

[11] Patent Number: 5,195,865

[45] Date of Patent: Mar. 23, 1993

[54] RAPID INTERCHANGEABILITY DEVICE FOR EARTH-MOVING DEVICES CARRYING VIBRATORS

[76] Inventor: Jean Koehl, 3 rue Varengue, 92340 Bourg La Reine, Hauts de Seine, France

[21] Appl. No.: 918,901

[22] Filed: Jul. 21, 1992

Related U.S. Application Data

[63] Continuation of Ser. No. 691,663, Apr. 25, 1991, abandoned, which is a continuation of Ser. No. 358,022, May 30, 1989, abandoned.

[30] Foreign Application Priority Data

May 30, 1988 [FR] France ..... 88 07169
May 29, 1989 [FR] France ..... 89 07000

[51] Int. Cl.[5] ..... E02F 3/28

[52] U.S. Cl. ..... 414/723; 37/DIG. 18; 172/40

[58] Field of Search ..... 414/723, 686; 172/40; 37/DIG. 18

[56] References Cited

U.S. PATENT DOCUMENTS

| | | | |
|---|---|---|---|
| 2,850,815 | 9/1958 | Edwards | 37/DIG. 18 X |
| 4,236,857 | 12/1980 | Willi | 414/723 X |
| 4,253,793 | 3/1981 | Branl | 414/723 |
| 4,439,938 | 4/1984 | Grant | 414/723 X |
| 4,480,955 | 11/1984 | Andrews et al. | 414/723 |
| 5,098,252 | 3/1992 | Sheesley et al. | 414/723 |

FOREIGN PATENT DOCUMENTS

| | | | |
|---|---|---|---|
| 922519 | 1/1955 | France | 37/DIG. 18 |
| 2304726 | 3/1975 | France | 414/723 |
| 3108521 | 10/1982 | France | 172/40 |
| 3610140 | 10/1987 | France | 172/40 |
| 2602256 | 2/1988 | France . | |
| 0616475 | 7/1978 | U.S.S.R. | 188/83 |
| 0938771 | 6/1982 | U.S.S.R. | 172/40 |
| 1016445 | 5/1983 | U.S.S.R. | 172/40 |
| 1237795 | 6/1971 | United Kingdom | 37/DIG. 18 |
| 8303629 | 10/1983 | World Int. Prop. O. | 414/723 |
| 8504440 | 10/1985 | World Int. Prop. O. | 414/723 |

*Primary Examiner*—Michael S. Huppert
*Assistant Examiner*—William M. Hienz
*Attorney, Agent, or Firm*—Browdy and Neimark

[57] ABSTRACT

The rapid attachments of the carrier are identical to those of the vibrator. The attachments of the corresponding tool carriers or tools are also identical for enabling thereby an entire interchangeability of all the elements between themselves. Adjusting devices are provided to adjust the resiliency amplitude of the dampers.

20 Claims, 6 Drawing Sheets

RAPID INTERCHANGEABILITY DEVICE FOR EARTH-MOVING DEVICES CARRYING VIBRATORS

This application is a continuation of application Ser. No. 07/691,663, filed Apr. 25, 1991 and now abandoned, which is a continuation of application Ser. No. 07/358,022, filed May 30, 1989 and now abandoned.

FIELD OF THE INVENTION

The present invention is an improvement to the exploitation conditions of earthmover machines using vibrators.

BACKGROUND OF THE INVENTION

Earthmover machines, such as hydraulic shovels, are frequently used for a plurality of various operations in addition to the earth-moving operation as such. Such operations require in general the replacement of the machine scoop by an appropriate tool means.

By way of example, there is used for earth-moving operation a so-called "retro" scoop which is replaced, for compacting, by a compaction hydraulic tool. The changing operations, as such, entail a considerable loss of time and a considerable reduction of efficiency.

The purpose of the present invention is to remedy the hereabove disadvantages and, particularly, to facilitate the disassembling or remounting operations which are made necessary by the change of nature of the work to be carried out.

On the other hand, French patent 2,602,256 to Applicant shows various possible uses for a vibrator underneath a shovel.

Therefore, the present invention proposes to ensure the optimum conditions for a shovel operator, without changing place inside his cabin, to be able to adapt, on the vibrating unit mounted under its shovel, a large number of tool means of any type by providing thus a device fulfilling reception and blocking functions of the tool means, as well as an omnidirectional blockage of the vibrator and, accessorily, a mechanical and hydraulic rotation function of the entire device.

SUMMARY AND OBJECTS OF THE INVENTION

It is therefore an object of the invention that tools or tool holders of such earth mover machines are provided with rapid attachment means for an instantaneous interchangeability with respect to the vibrating unit which is in turn provided with corresponding instantaneous attachment means. The vibrating unit is composed of a vibrator separated from the attachment to the shovel by dampers the movement of which can be totally suppressed by a remote mechanical blocking of the vibrating and non vibrating elements of the vibrating unit between themselves, or by partially blocking the amplitude of the dampers by an adjustment of the distance between the non vibrating portion and the ground which will be the reference and rolling line. The vibrating unit is provided in turn with rapid attachment means similar to those of the tools or tool holders, and connected to corresponding rapid attachment means fixed underneath the shovel, which rapid attachment means underneath the shovel are provided with interchangeability means from one shovel to another.

It should also be noted that the corresponding interchangeability means of the vibrating unit are similar to those of the rapid attachment unit fixed underneath the shovel, and samely the rapid interchangeability attachments of the tool holders and tools are similar to those of the tools for enabling an entire interchangeability of all the components underneath the shovel or the vibrating unit.

According to the invention, the instantaneous interchangeability device for tool means of earthmovers includes a vibrating unit connected to the carrier arms by a plate and including dampers for connection with said plate, remotely controlled means mounted between the vibrating unit and the plate for providing controlled blockage in a resiliency of the dampers, connecting means being provided, in a corresponding manner, respectively on the vibrating unit and on an instantaneous connection plate for a removable connection between the vibrating unit and the instantaneous connection plate which comprises, in turn, nesting means cooperating with corresponding means provided on the vibrating unit, this connection plate forming a part of an earth moving tool such as a hydraulic shovel, or being connectable to such a tool.

According to another feature of the invention, the plate for connection to the shovel arms is, as such, an instantaneous connection plate, the end of the shovel arm being connected to a support chassis, and means being provided on this support chassis, and means being provided on this support chassis for a removable connection with this instantaneous connection plate. These means, as provided, will be similar to those installed on the vibrating unit.

Various other features of the invention will become more apparent from the following detailed description.

SHORT DESCRIPTION OF THE DRAWINGS

Embodiments of the invention are shown, by way of non limiting examples, in the accompanying drawings, wherein.

DESCRIPTION OF PREFERRED EMBODIMENTS

Figure 1:
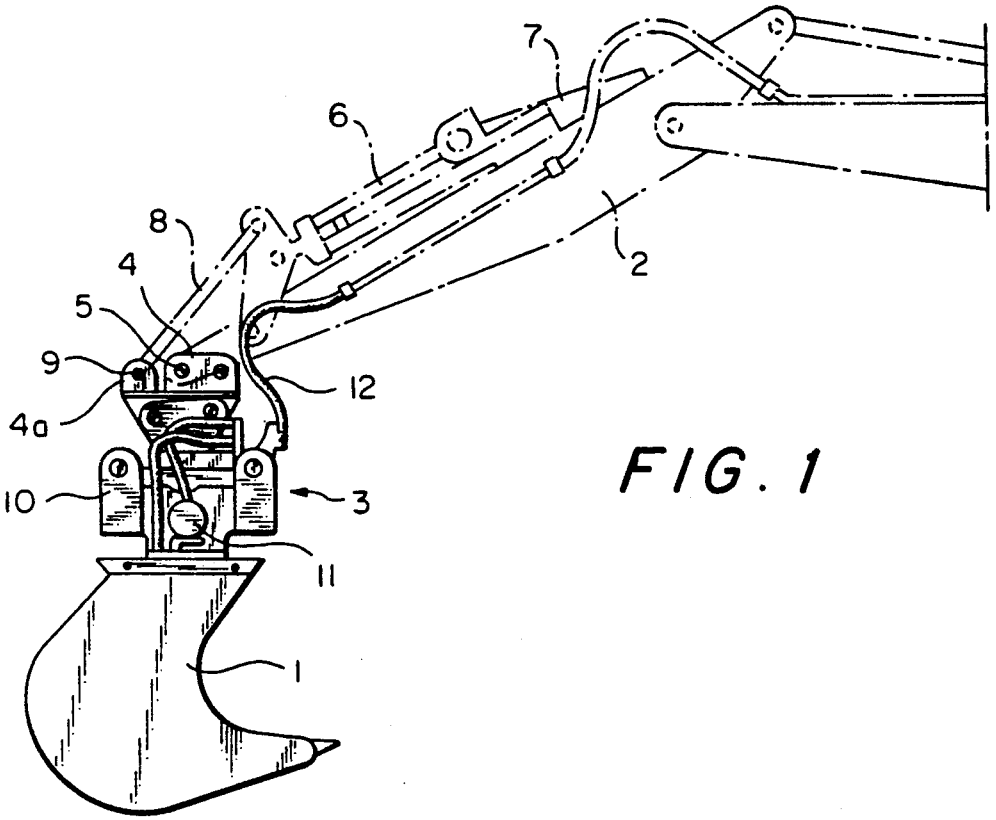
FIG. 1 is a partial view of an earthmover machine to which the interchangeability device according to the invention is applied.

Turning now in greater detail to the drawings, and first to FIG. 1, there is shown, in a schematic way, an earth-moving tool comprising a scoop 1 connected to a shovel arm 2 of an earthmover machine through an interchangeability device generally indicated by reference 3. As shown, the interchangeability device 3 has a lug 4 comprising a pin 5 for articulating the assembly of the interchangeability device 3 and scoop 1 to the shovel arm.

Moreover, a hydraulic cylinder 6 comes to bear, in a manner known per se, on the one hand at 7 on the shovel arm 2 and, on the other hand, via a connecting rod 8, on an articulation point 9 of a second lug 4*a* of the interchangeability device 3. It is thus possible to control, via the cylinder 6 and the hydraulic central unit of the earthmover machine, the rotation of the scoop 1 with respect to the arm 2.

Figure 2:
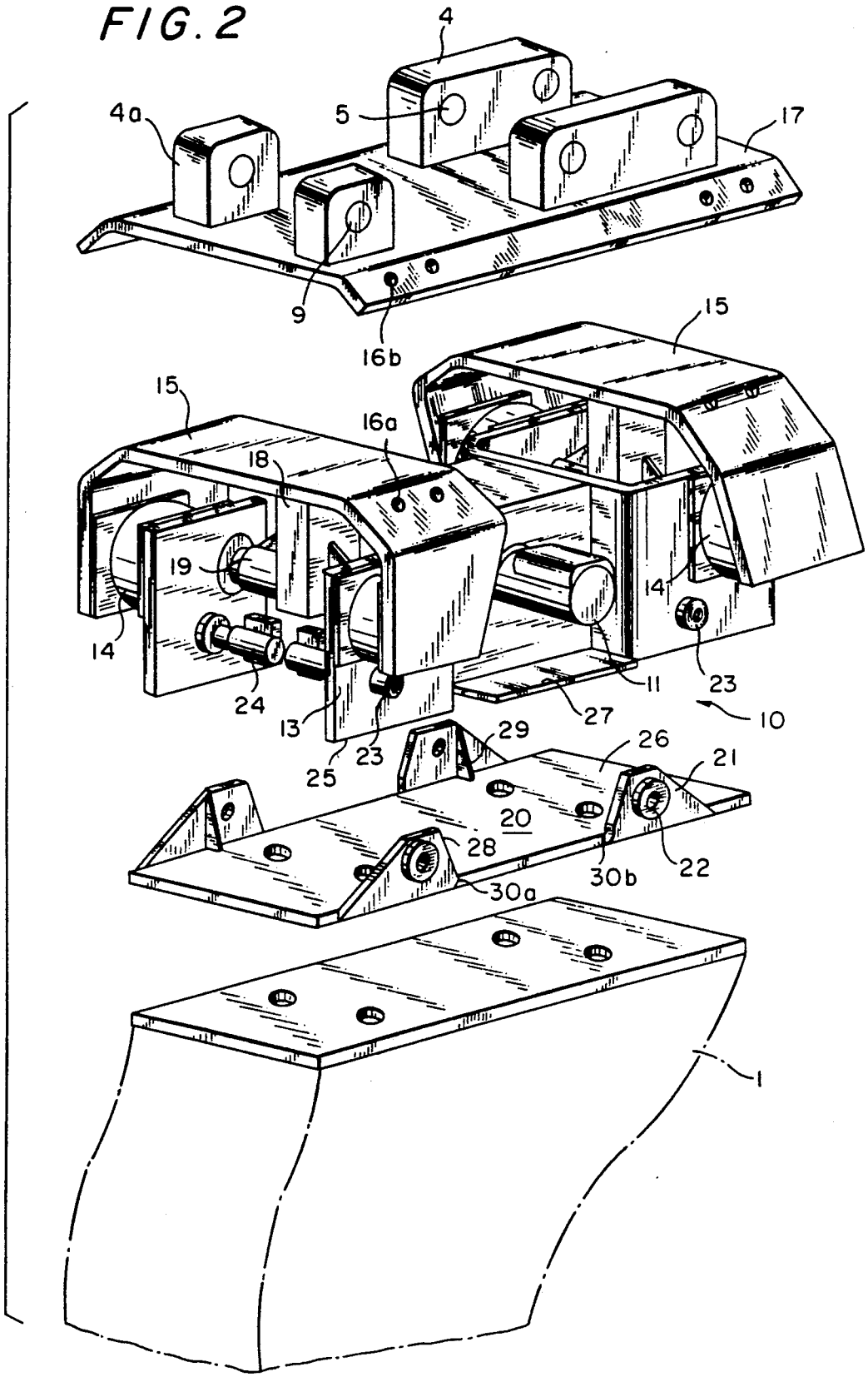
FIG. 2 is an enlarged exploded view of the interchangeability device according to the invention.

As it may be also seen in a more detailed manner in FIG. 2, which shows the entire interchangeability device 3 in a mounted position, the interchangeability device 3 includes a vibrating unit 10, which serves as a connector, of a type known per se and comprising, for example, an excentered fly-weight vibrator, an electromagnetic vibrator or, preferably, a vibrator 11 of the hydraulic type connected to the central unit of the earthmover machine by flexible lines 12 (FIG.1).

In FIG. 2, the vibrating unit 10 terminates on both sides with lateral wings 13 forming a housing for fixation of dampers 14 to stirrups 15 adapted for being connected at 16*a*, 16*b* to a connection plate 17 for connection to the shovel of FIG. 1 and which has to this effect the hereabove mentioned connection lugs 4 and 4*a*.

The dampers 14, which are known in the art as silent-blocks, are made for example of armoured rubber and are used so that the vibration caused by the vibrating unit 10 are not transmitted to the shovel arm 2 of FIG. 1 through the connection plate 17.

However, when the earthmover machine is provided with a scoop used for a tearing-away operation and not for compacting as provided in the above mentioned French patent 2,602,256 to Koehl, it is then advantageous to be able to mechanically connect, in a controlled manner, the scoop 1 to the connection plate 17 by controlling omnidirectional blockage of the play of the dampers 14.

To this effect, each one of the stirrups 15, which are connected at 16*b* to the connection plate 17, has a central mechanical transmission vertical arm 18 on which are mounted control means 19 such as hydraulic cylinders adapted for being remotely controlled via the earthmover hydraulic central unit, and having their piston rods coming in abutment against the wings 13 of the vibrating unit 10, thereby mechanically controlling the omnidirectional play of the dampers 14. In order to remotely control the blockage of the dampers 14, it is also possible, according to the invention, to provide that the control means 19 is an electromagnetic braking device mounted between the arm and the wing, and controlled from a known electric central unit at the disposal of an operator of the earthmover machine.

Moreover and as it may be seen clearly in FIG. 2, the interchangeability device 3 according to the invention further includes an instantaneous connection plate 20 adapted for any tool, such as the scoop 1 fixed underneath it by any appropriate means, and has receiving ears 21 with conical perforations 22 adapted for receiving blockage pins 23 controlled by hydraulic cylinders 24 extending through the wings 13 of the vibrating unit 10 and supplied by the earthmover hydraulic central unit.

Just as for the hereabove mentioned remote controlled blockage of the play of the dampers, it is here also possible to provide an electromagnetic arrangement as well as any other arrangements for controlling introduction of the blockage pins 23 inside the conical perforations 22 and, respectively, their retraction outside the conical perforations 22 of the connection plate 20, the purpose being, in all cases, to provide a so-called "instantaneous" or rapid interchangeability between the connection plate 20 and the vibrating unit 10.

Moreover and as it may also be seen in FIG. 2, when assembling the connection plate 20, while at the same time the pins 23 are blocked in the conical perforations 22, the base 25 of the wings 13 of the vibrating unit 10 is blocked against the upper portion 26 of the connection plate 20.

In addition, the receiving ears 21 have a particular trapezoidal shape with slanting planes ensuring an easy guiding of the vibrating unit into the connection plate 20 when gripping a tool such as the scoop 1.

Thus, a horizontal plate 27, provided in the central portion of the vibrating unit 10 between the wings 13 of the same, is guided along slanting planes 28 bordering the receiving ears 21, at the same time as the wings 13 are guided along the slanting planes of square members 29 perpendicular to the plane of the receiving ears 21.

It is thus clear that, when the vibrating unit 10 has reached the end of the various hereabove mentioned guides, it will be automatically positioned between blockages 30*a* and 30*b* of the receiving ears 21, by providing a positive nesting of the connection plate 20 on the vibrating unit 10. What remains then to do is to latch the connection with the hydraulic cylinders 24, the blockage pins 23 of which will extend into the conical perforations 22 of the connection plate 20.

As seen hereabove, the interchangeability device according to the invention provides for a total blockage of the connection plate 20 on the vibrating unit 10 and a permanent take up of the plays of the vibrating unit 10 with respect to the connection plate 20. Thus, the mounting so adopted is composed of four cylinders 24 ending into the cone-shaped blockage pins 23 and placed at the front and at the rear of the vibrating unit 10. As stated above, the function of the cylinders 24 is to house their blockage pins 23 into the corresponding conical perforations 22 of the receiving ears 21 of the connection plate 20, and which are preferably mounted sideways as shown in the drawing.

Moreover, the positioning of the cylinders 24, the length of the wings 13 of the vibrating unit 10 with respect to the instantaneous connection plate 20 forming a tool holder, as well as the positioning of the horizontal guiding plate 27 formed between the receiving wings 13, are calculated in such manner that, during the blockage by the hydraulic cylinders 24, the connection plate 20 is totally blocked against the base of the vibrating unit 10. In this manner and as seen hereabove, twelve blockage points are obtained with only four cylinders 24, which enables a positive nesting of the connection plate 20 on the vibrating unit. In FIG. 2 there is shown cylinder 19 which is engaging a wing 13 on the left side of the vibrating joint assembly. Since the cylinder applies pressure between the wing and the mechanical transmission arm, the wing 13 lock into position with respect to the arm 18 in three degrees of freedom. Since there are four of these joints, there are a total of twelve blockage points provided in the assembly.

Figure 3:
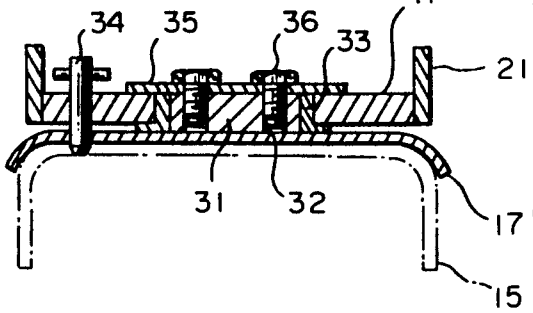
FIG. 3 shows a connection plate provided with a rotation device.

FIG. 3 shows the connection plate 17' of provided with a rotation device. By way of example, a very strong vertical pin 31 will be fixed, by any suitable means, on the stirrup 15 of FIG. 2, and to this effect, the pin 31 will be provided with holes and threads 32. The connection plate 17' will be preferably provided with a round recess for the positioning of self-lubricating elements 33, in bronze or other rotation favorizing material. A suitable blockage device 34 will enable a positioning of the connection plate 17' with respect to the connection plate 17' which connects the stirrups 15. The final mounting of the rotation device of FIG. 3 will be provided by a plate 35 secured by bolts 36.

Figure 4:
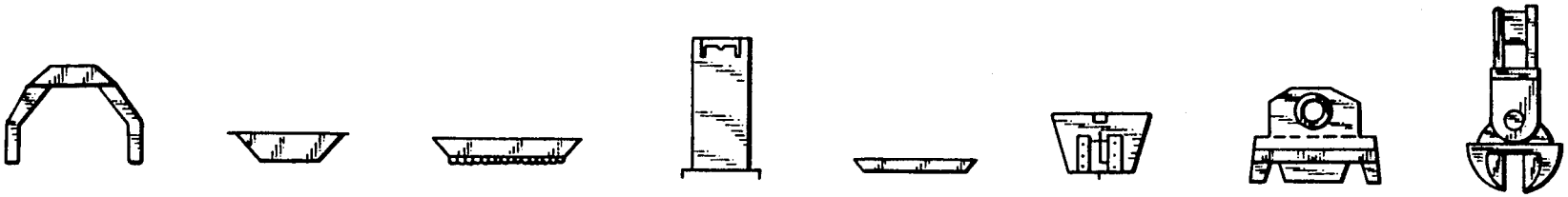
FIG. 4 shows various earth-moving tools adapted for being used in connection with the invention.

FIG. 4 shows a certain number of tools amongst which are a side compactor for large pipes, an asphalt cutter, a compaction plate with a pile-driver foot; such tools being mountable on the connection plate 20 instead of the scoop 1 of FIGS. 1 and 2. Likewise, the connection plate 20 can, as such, be part of a tool itself (see also FIG. 9).

Figure 5:
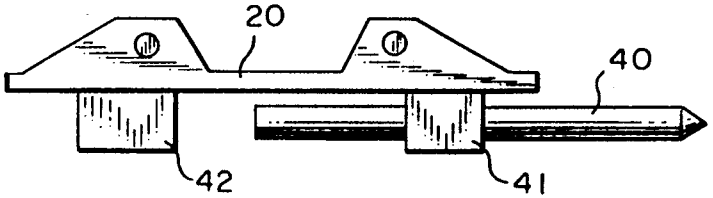
FIG. 5 shows a drilling pick forming a rock cutter, mounted underneath the connection plate of the interchangeability device of the preceding figures.

FIG. 5 shows a particularly simple mounting of a drilling pick under the connection plate 20. The drilling pick 40 will be guided in a bore of its support 41 according to the pre-chosen stroke length. An abutment 42 is provided underneath the connection plate 20 so that the rear of the drilling pick 40 is hit by the abutment 42 when the shovel of the earthmover machine will exert a thrust on an obstacle. There is thus obtained a rock breaker. Other tools, such as a spade, may also be used.

On sanitation working sites with two shovels, one of these shovels is used for moving the earth while the other is equipped with a vibrating unit with its various interchangeable tools. On working sites with only a single shovel, the shovel will be provided with an equipment, and the rapid connection plate 20, hydraulically fixed on the vibrating unit 10, can in turn be provided with hydraulically controlled devices. This is the case of hydraulic clamps for sheet piles.

In other corporations, for example telegraph pole layers, one will use a tube welded underneath the connection plate 20. This tube will have a shape and a size appropriate to the hole to be formed for erecting the poles. On another connection plate, it will be possible to mount a clamp provided to be hydraulically controlled in a manner known per se and, when erecting the poles, the hole will be formed by associating the tube to the vibration of the vibrating unit 10. Handling and positioning of the pole will be done either by a clamp mounted under the vibrating unit, the movement of which having been blocked by the hereabove provided mechanical blockage, or, after dismounting the vibrating unit, by an instantaneous fixation directly on the arm of the handling clamp mounted on the connection plate.

The above description was concerned more particularly with an interchangeability of tool means under vibrators mounted on hydraulic shovels or other earthmover machines.

In the following description, the connection means are greatly improved and offer new possibilities of use since the vibrating unit 10 is, as such, easily interchangeable on the shovel, and since the same tools, which are usable underneath the vibrating unit, will also be usable in the same manner directly underneath the shovel arm.

What follows permits thus to rationalize and technically harmonize the attachment means on the vibrating unit and the attachment means underneath the shovel for receiving the same tools.

Figure 6:
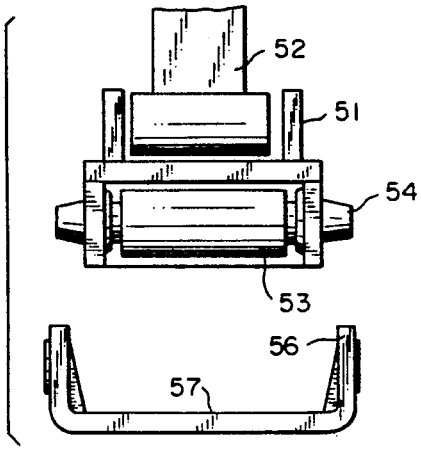
FIG. 6 is a front view of the fixation of the connection plate of the preceding figures to a support frame connected to the shovel arm.
Figure 7:
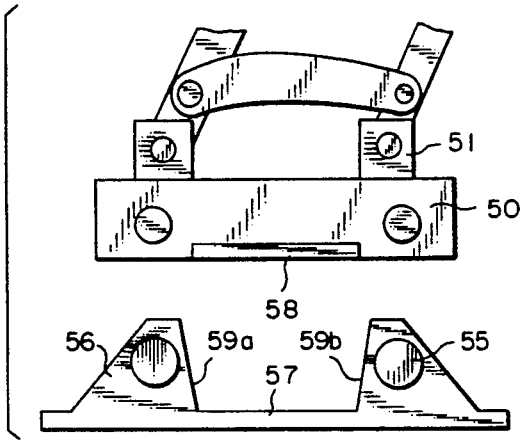
FIG. 7 is a side view of FIG. 6.

In FIGS. 6 and 7, there is shown a new element composed of a support frame or connector 50, the upper portion of which receives receiving attachments 51 of a shovel arm 52 similar to the shovel arm 2 of FIG. 1, the receiving attachments 51 having then a similar function as that of the lugs 4 and **4*a* of FIG. 2**.

The U-shaped support frame 50 is provided for holding hydraulic cylinders 53 whose conical blockage pins 54 extend in corresponding perforations 55 formed in ears 56 of a connection plate 57 similar to the instantaneous connection plate 20 of the preceding figures. The distance between the conical blockage pins 54 and the edge of the wings of the U-shaped support frame 50 corresponds to what has been previously described with respect to the vibrating unit 10, the support frame 50 playing the same role, as regards the connection thereof to the plate 57, as the vibrating unit 10 with respect to the plate 20.

Dispositions similar to those previously described may also be provided on the support frame 50 so as to cooperate with corresponding elements provided on the connection plate 57. It is shown, for example in FIG. 7, that a horizontal plate 58 of the support frame 50 is guided between blockages **59*a* and 59*b* of the connection plate 57 for contributing to a nesting of the support frame 50 on the instantaneous connection plate 57, in the very same way as in FIG. 2 for the guiding plate 27 and blockages 30*a*, 30*b***.

In such a way, it will be possible to mount tools on connection plates which will be connected either directly to the shovel arm or via the vibrating unit 10. It is thus clear that, in the first case, the connection plate 57 fulfills the function of the plate 17 in FIG. 2.

Figure 8:
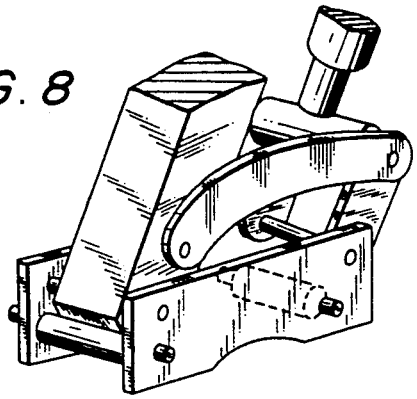
FIG. 8 shows an alternative embodiment of the arrangement of FIGS. 6 and 7.

FIG. 8 shows a small variant in which the wings of the U of the support frame have been arranged in consideration to a different tool to be mounted, without however this arrangement modifying the functions of the entire interchangeability device according to the present invention.

Figure 9:
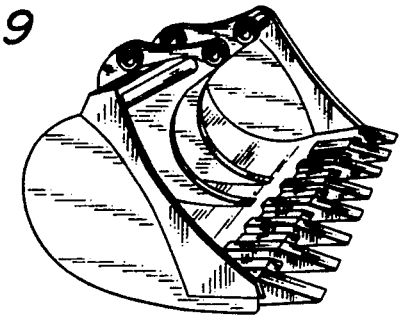
FIG. 9 shows an earth-moving scoop having conical holes for its connection to an earth-moving tool.

As it may be seen in FIG. 9, in the case of earthmover scoops for example, there will be formed, in the plate for connection to the scoop, conical openings similar to the conical openings 22 of the connection plates 20 and 56 of the preceding figures. Similarly, bearing points will be provided, in an identical manner as regards positioning and support, in such a way that it may then be possible to mount the scoop either directly underneath the shovel or under the vibrating unit.

The hydraulic supply will be possibly obtained from the hydraulic circuit of the carrier. Supply will also be possible from a specific hydraulic circuit, or from the scoop cylinders provided with branch lines controlled by electrovalves.

Figure 10:
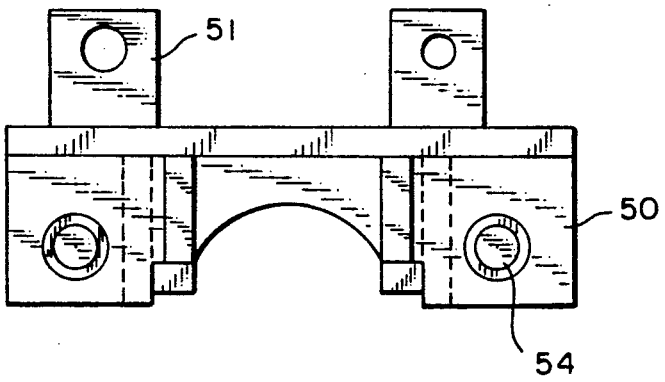
FIGS. 10, 11 and 12 show shovel attachments directly mounted on the connection means (FIGS. 10–11) or on an interchangeable plate with respect to the connection means (FIG. 12)
Figure 11:
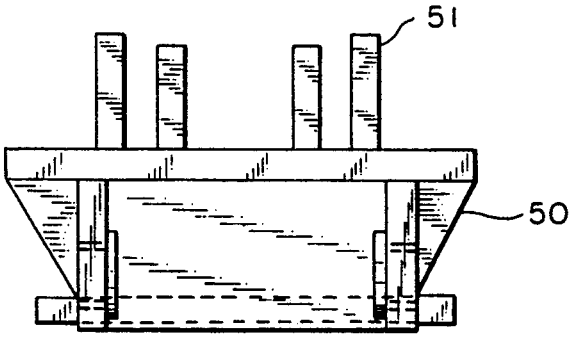
Figure 12:
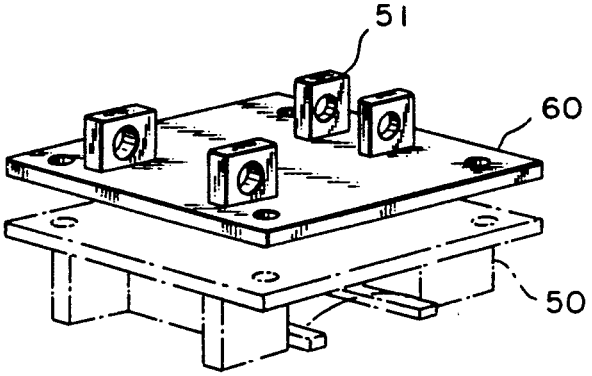

FIGS. 10–12 correspond to FIG. 6, where the frame 50 with its means 54 can receive, in a fixed and definite manner (FIGS. 10 and 11), or in an interchangeable manner (FIG. 12), the receiving attachments 51 which will be fixed on a plate 60, which is then bolted on top of the frame 50.

On sanitation or road work sites, other works have to be performed, such as a drilling of coated materials. An advantageous manner will consist, therefore, in using the vibratory energy already present in the form of the vibrating unit 10.

Figure 13:
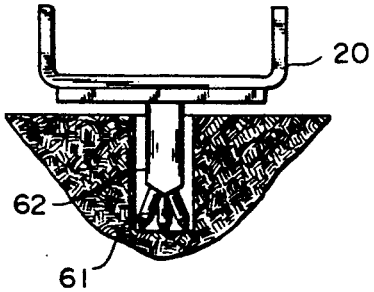
FIG. 13 shows an arrangement of tungsten tines mounted on a support which is in turn mounted on a connection plate.
Figure 14:
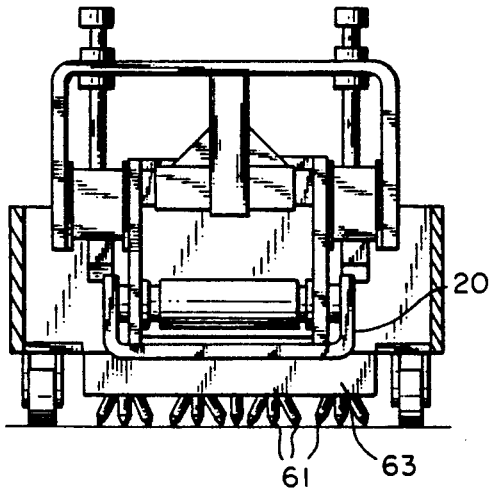
FIG. 14 shows several supports with tines mounted as an assembly on a connection plate which is in turn mounted on the vibrating unit.
Figure 15:
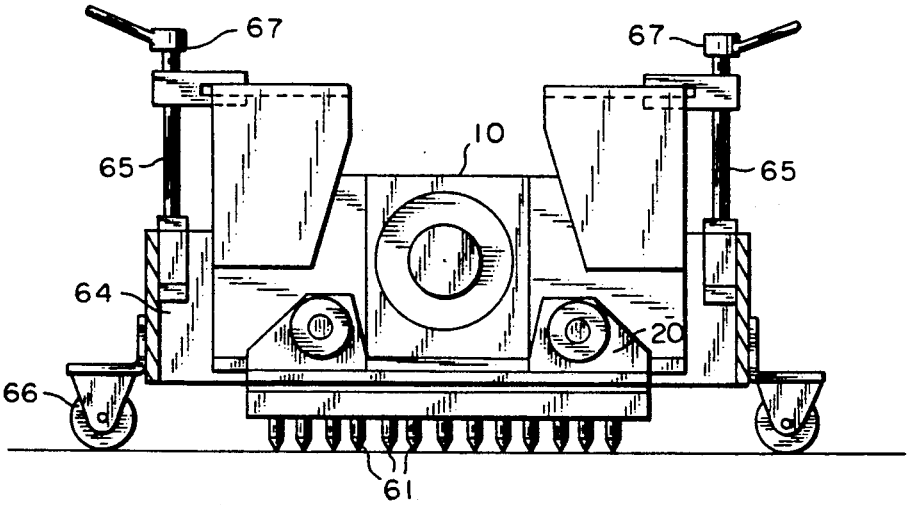
FIG. 15 shows the vibrating unit acting on the connection plate and tines, adjusting devices being mounted on a chassis running on the ground.

In FIGS. 13, 14, 15, tungsten tines 61 will be mounted in series in an appropriate manner corresponding to the result to be obtained. Thus, a longitudinal support 62 will receive a row of tines implanted according to a plane which is either vertical for a vertical support, or which is inclined in contrary to the advance direction of the apparatus, such as ploughshares.

A single one of these supports 62 mounted on the tool holder or connection plate 20 will be used for cutting coated materials along a narrow and deep cut. Several of these longitudinal supports, mounted side by side, will form a drilling surface 63 which the shovel or the carrier will make to work at their own rythm.

In order for the work to be homogeneous, it remains to adjust an influence of the pressure of the shovel on the vibrating unit, and therefore the depth effect of the tines.

Considering the non vibrating upper portion 17 of the vibrating unit, connected to the shovel through the receiving attachments 51, it is convenient to fix, thereupon by suitable fixation means 67, a chassis 64 or any other means provided with adjusting means 65 and bearing on a ground via small wheels 66.

In FIG. 15, the connection plate 20, with its tines 61, will be fixed on the vibrating unit 10 which, due to its rotation, will provide on a ground a scarifying effect, either vertically for a roughening work, or in oblique for a drilling work.

Due to the adjustable height between the non vibrating portion 17 and a ground, and the movement of the dampers according to the effect of the vibrations, the drilling depth will correspond to the depth preset by the adjusting means. In the previous sentence, the ground refers to the road or surface upon which the work is to be done. Reference to FIG. 15 shows that the varying of height between the non-vibrating portion (17) and the road, and where the height (10) can be modified by adjusting of jack 65, 67.

Four adjusting means 65 will preferably be installed. They will allow to adjust the angle of attack for the scarifying effect which will be made in parallel longitudinal layers as a function of the chosen depth, the first tines of the system being the highest and therefore close to the surface, and the last ones being the deepest at the required depth.

Figure 16:
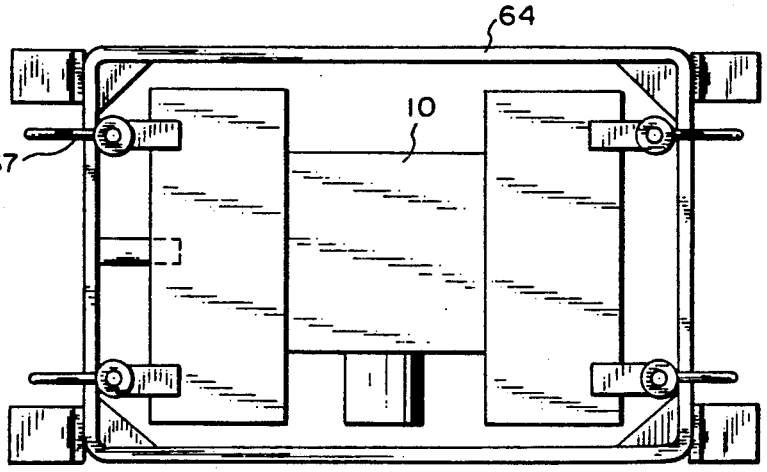
FIG. 16 shows rotary fixation means for mounting the chassis of FIG. 15 on the vibrating unit.

FIG. 16 shows a top view in which the fixation means 67 provided for mounting the chassis 64 of FIG. 5 on the vibrating unit 10 are rotary means for an easy mounting from the above.

I claim:

1. A rapid interchangeability device for selectivity engaging construction tools to a shovel arm of an earth mover, said device comprising:

a connector (10–50), a first rapid interchangeability connection plate (17–60), said first connection plate being connected to said connector (10) and having receiving ears (4, 4a; 51) with perforations (5, 9), said shovel arm (2; 52) having connecting means comprising blocking pins with actuating means for controllably extending said pins from said arm into said perforations of said first connection plate, a second rapid interchangeability connection plate (20; 57), said second connection plate having receiving ears (21; 56) with perforations (22; 55), said connector (10; 50) having blocking pins (23; 54) with actuating means (24; 53) for controllably extending said connector blocking pins from said connector into said perforations of said second connection plate and guiding members (27; 58) operatively cooperating with said receiving ears of said second connection plate for guiding said connector into fixed engagement with said connection plate.

2. A device as set forth in claim 1, wherein said second connection plate integrally includes an earth moving tool.

3. A device as set forth in claim 1, wherein said second connection plate is a holder for at least one earth moving tool.

4. A device as set forth in claim 1, wherein said connector comprises a vibrating unit (10), dampers (14) being connected to said first connection plate.

5. A device as set forth in claim 4, further comprising remotely controlled blockage means mounted between said vibrating unit and said first connection plate for providing a controlled blockage of movement in said dampers.

6. A device as set forth in claim 5, wherein said first connection plate is connected to a mechanical transmission intermediate element, said controlled blockage means having at least one cylinder mounted between said intermediate element and a wing of said vibrating unit.

7. A device as set forth in claim 5, wherein said first connection plate is connected to a mechanical transmission intermediate element, said controlled blockage means having an electromagnetic device mounted between said intermediate element and a wing of said vibrating unit.

8. A device as set forth in claim 1, wherein said receiving ears of said second connection plate are formed with conical perforations for receiving said connector blocking pins, said connector blocking pins having conical ends.

9. A device as set forth in claim 1, wherein said actuating means for controllably extending said connecting means pins into said perforations of said first connection plate comprises hydraulic cylinder means.

10. A device as set forth in claim 1, wherein said actuating means for controllably extending said connector blocking pins into said perforations of said second connection plate comprises hydraulic cylinder means.

11. A device set forth in claim 1, wherein said actuating means for controllably extending said connector blocking pins into said perforations of said second connection plate comprises an electromagnetic arrangement.

12. A device as set forth in claim 1, wherein said connector has a side portion with a base which abuts against an upper portion of said second connection plate.

13. A device as set forth in claim 1, wherein said receiving ears of said second connection plate are provided with slanting planes for cooperating with said guiding members provided on said connector for ensuring a positive blockage.

14. A device as set forth in claim 1, wherein said receiving ears of said second connection plate are provided with slanting planes for cooperating with said guiding members of the connector to guide said connector into fixed engagement with said second connection plate.

15. A device as set forth in claim 1, and further comprising a rotation device.

16. A device as set forth in claim 1, wherein the second connection plate comprises an abutment and a sheath guiding a drilling pick forming a rock breaker.

17. A device as set forth in claim 1, wherein the second connection plate is connected to a scoop.

18. A device as set forth in claim 1, wherein said second connection plate has tine supports with tines.

19. A device as set forth in claim 1, wherein said second connection plate has means for the adjusting and rolling thereof.

20. A device as set forth in claim 1, wherein said receiving ears of said second connection plate are formed with four perforations for receiving four of said connector blocking pins, said connector blocking pins having conical ends.

* * * * *